US008991541B1

(12) United States Patent
Maier

(10) Patent No.: US 8,991,541 B1
(45) Date of Patent: Mar. 31, 2015

(54) MOTORIZED SNOWBOARD

(71) Applicant: Jason N Maier, Denfield (CA)

(72) Inventor: Jason N Maier, Denfield (CA)

( * ) Notice: Subject to any disclaimer, the term of this patent is extended or adjusted under 35 U.S.C. 154(b) by 0 days.

(21) Appl. No.: 14/096,671

(22) Filed: Dec. 4, 2013

(51) Int. Cl.
*A63C 5/035* (2006.01)
*A63C 5/08* (2006.01)

(52) U.S. Cl.
CPC ..... *A63C 5/08* (2013.01)
USPC ..... 180/181; 180/190; 180/193

(58) Field of Classification Search
CPC ..... B62M 27/02; B62D 55/07; A63C 5/085; A63C 5/08; A63C 5/03; A63C 17/12
USPC ..... 180/180, 181, 182, 184, 186, 190, 191, 180/192, 193
See application file for complete search history.

(56) References Cited

U.S. PATENT DOCUMENTS 5,409,244 A * 4/1995 Young ..... 280/14.22
5,505,477 A * 4/1996 Turner et al. ..... 280/613
5,564,719 A * 10/1996 Kisselmann ..... 280/14.23
5,586,779 A * 12/1996 Dawes et al. ..... 280/14.24
5,609,347 A * 3/1997 Dressel ..... 280/14.23
5,649,722 A * 7/1997 Champlin ..... 280/818
5,662,186 A * 9/1997 Welch ..... 180/181
5,690,350 A * 11/1997 Turner et al. ..... 280/613
5,727,797 A * 3/1998 Bowles ..... 280/14.21
5,769,445 A * 6/1998 Morrow ..... 280/610
5,802,741 A * 9/1998 Turner et al. ..... 36/117.3
5,816,590 A * 10/1998 Fey et al. ..... 280/14.22
5,855,385 A * 1/1999 Hambsch ..... 280/87.042
5,857,700 A * 1/1999 Ross ..... 280/623
5,868,408 A * 2/1999 Miller ..... 280/87.042
5,884,933 A * 3/1999 Trott ..... 280/603
5,906,058 A * 5/1999 Rench et al. ..... 36/117.1
6,007,101 A * 12/1999 Pritchard et al. ..... 280/809
6,076,287 A * 6/2000 Savard ..... 36/118.2
6,139,473 A * 10/2000 Koyama et al. ..... 482/8
6,179,305 B1 * 1/2001 Capozzi et al. ..... 280/28.14
6,220,631 B1 * 4/2001 Pritchard et al. ..... 280/809
6,394,483 B2 * 5/2002 Stubblefield ..... 280/602
6,435,290 B1 * 8/2002 Justus et al. ..... 180/9.1
6,848,527 B2 * 2/2005 Nelson ..... 180/181
7,434,644 B2 * 10/2008 Wier ..... 180/180
7,686,109 B2 * 3/2010 Brazier ..... 180/9.44
7,784,571 B2 * 8/2010 Brazier ..... 180/9.44
7,900,723 B2 * 3/2011 Brazier ..... 180/9.44
7,905,310 B2 * 3/2011 Hues ..... 180/180
8,091,671 B1 * 1/2012 Horsey et al. ..... 180/181
8,205,696 B2 * 6/2012 Brazier ..... 180/9.44
8,596,399 B1 * 12/2013 Gauld ..... 180/181
2001/0040352 A1 * 11/2001 Wang et al. ..... 280/87.01
2001/0052679 A1 * 12/2001 Stubblefield ..... 280/14
2002/0058237 A1 * 5/2002 Kernan ..... 434/247
2002/0074176 A1 * 6/2002 Justus et al. ..... 180/181
2004/0056451 A1 * 3/2004 Baikhardt ..... 280/618
2004/0065494 A1 * 4/2004 Nelson ..... 180/181
2007/0205034 A1 * 9/2007 Wier ..... 180/181
2008/0169146 A1 * 7/2008 Brazier ..... 180/181
2008/0169147 A1 * 7/2008 Brazier ..... 180/191
2008/0257627 A1 * 10/2008 Hues ..... 180/180
2009/0152037 A1 * 6/2009 Brazier ..... 180/191
2009/0227426 A1 * 9/2009 Dubar ..... 482/34
2009/0255745 A1 * 10/2009 Kukowski et al. ..... 180/190
2011/0209930 A1 * 9/2011 Brazier ..... 180/9.1

* cited by examiner

*Primary Examiner* — J. Allen Shriver, II
*Assistant Examiner* — Brodie Follman

(57) ABSTRACT

A motorized snowboard having a board with a cut out section at the rear of the board, a motor, a downwardly biased track system, and a track housing.

18 Claims, 2 Drawing Sheets

1
2
3
5
6
8
9
10
11
12
13
14
16
17
17
25a
25b
26
40

MOTORIZED SNOWBOARD

FIELD OF INVENTION

The present invention relates to motorized snowboards and, in particular, to improved designs for motorized snowboards.

BACKGROUND OF THE INVENTION

Traditionally, the sport of snowboarding is enjoyed on a downward slope. The snowboard, which is attached to the rider's feet with bindings, glides down the incline propelled by gravitational forces. The use of gravitational forces for acceleration has inherently limited the enjoyment of snowboarding to locations with an incline or towing means of propulsion.

SUMMARY OF THE INVENTION

The present invention relates to a motorized snowboard having a motorized track assembly for propulsion. An aspect of the invention is the track assembly which is downwardly biased underneath the board towards the snow surface for keeping the track in contact with the ground at all times in order to maintain operative traction between the track and the snow covered surface. Another aspect of the invention is a cut out rear section of the board to permit the ejection of the snow by the track and thus avoid snow buildup under the board during use.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION

Figures 1, 2:
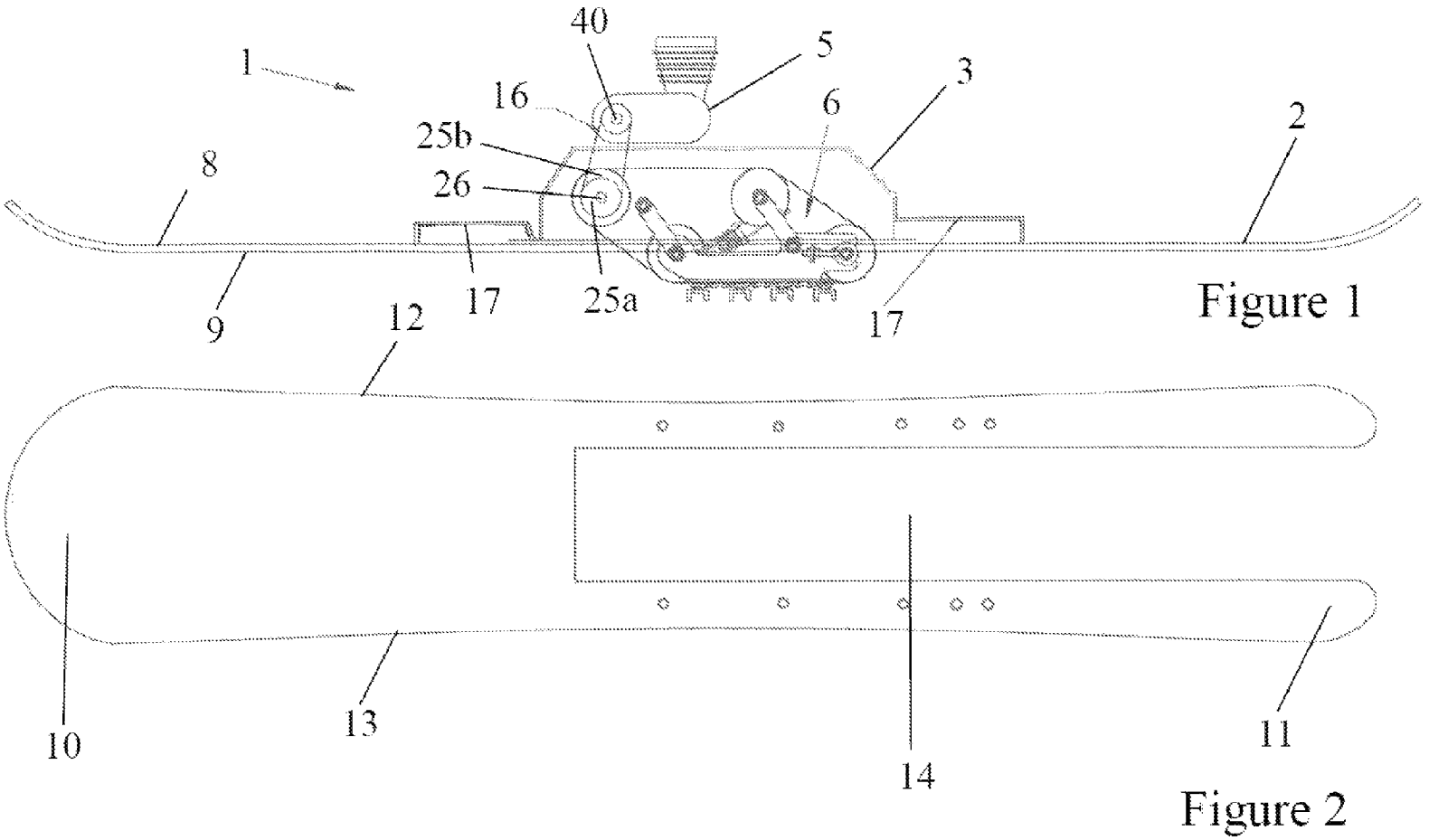
FIG. 1 is a schematic, partly sectional, side view of the motorized snowboard.
FIG. 2 is a bottom or top view of the board.

Referring to FIG. 1, a motorized snowboard 1 according to the present invention is shown. The motorized snowboard 1 comprises a board 2 having an open channel 14, as shown in FIG. 2. The motorized snowboard 1 further comprises a track housing 3, a track assembly 6, a motor 5 (partially shown).

The board 2 may be of any shape or construction common in the art of snowboard manufacture having a substantially planar top surface 8 and bottom surface 9, a front portion 10, a rear portion 11 and edges 12 and 13. As shown in FIG. 2, the board 2 has an open channel 14, resembling a rectangular longitudinal open space extending rearwardly to the end of the board from about the midpoint of the board 2. As will be more fully described herein, the forward portion of the channel accommodates the track housing 3. The rearward portion of the channel allows for the snow that is engaged and propelled rearwards by the track assembly 6 to be ejected rearward through the open channel 14 to avoid snow building up under the board 2.

Two conventional snowboard bindings (not shown) may be mounted on the top surface 8 in spaced apart relation forward and aft of the motor 5. In operation, a rider uses the bindings to secure their feet to the snowboard.

Referring to FIG. 1, the track housing 3 is preferably a thin-walled hollow body having a flat top surface, opposing sides, and an open bottom, which houses the track assembly and overlies the forward portion of the open channel 14. In the preferred embodiment, the open bottom of the track housing 3 is attached to the top surface 8 of the snowboard by way of a flange integrally formed around the bottom periphery thereof and attached to the snowboard by means of fasteners (not shown).

As shown in FIG. 1, the motor 5 (partially shown) may be mounted, by way of example, on the top surface of the track housing 3 by means known in the art, such as bolts (not shown). The motor 5 may be of any type known in the art suitable for use in the present application. A preferred example is a small gas powered motor with a variable drive transmission, such as a chainsaw motor, which rotates a drive shaft 40. Although it is preferred that the motor 5 is mounted on the top surface of the track housing 3, this particular placement of the motor 5 is not essential to the present invention. The motor 5 may be mounted anywhere on the motorized snowboard 1 where it does not hinder the operation or use of the motorized snowboard 1.

A hand-held power control device (not shown) may be used to allow the rider to control the power output of the motor 5 and resultantly control the speed at which the snowboard is being propelled forward during use. The power control device may be any means known in the art which can be used to selectively control the power output of a motor 5. A preferred power control device comprises a hand-held mechanical throttle control connected to the motor 5 by a cable.

The motor 5 is used to provide motive power to the snowboard by means of the drive shaft 40 which is operatively connected by any suitable means known in the art to a drive roller 25*b* on the track assembly. In a preferred embodiment, shown in FIG. 1, the drive shaft 40 is connected to a drive sprocket 25*a* by a drive chain 16. The ends of the drive chain 16 are secured together to create an endless loop.

The drive sprocket 25*a* is mounted on a drive axle 26 and is engaged with the drive chain 16 to convert the motive power received from the drive shaft 40, via the drive chain 16, into rotation of the drive axle 26. The drive axle 26 is located and rotably secured between opposing side walls of the track housing 3 by means of bearing assemblies. The drive roller 25*b* is mounted on the drive axle 26, preferably in spaced apart relationship to drive sprocket 25*a*, and engages the roller chain 21 of the continuous track 20 to transfer motion thereto.

Figure 3:
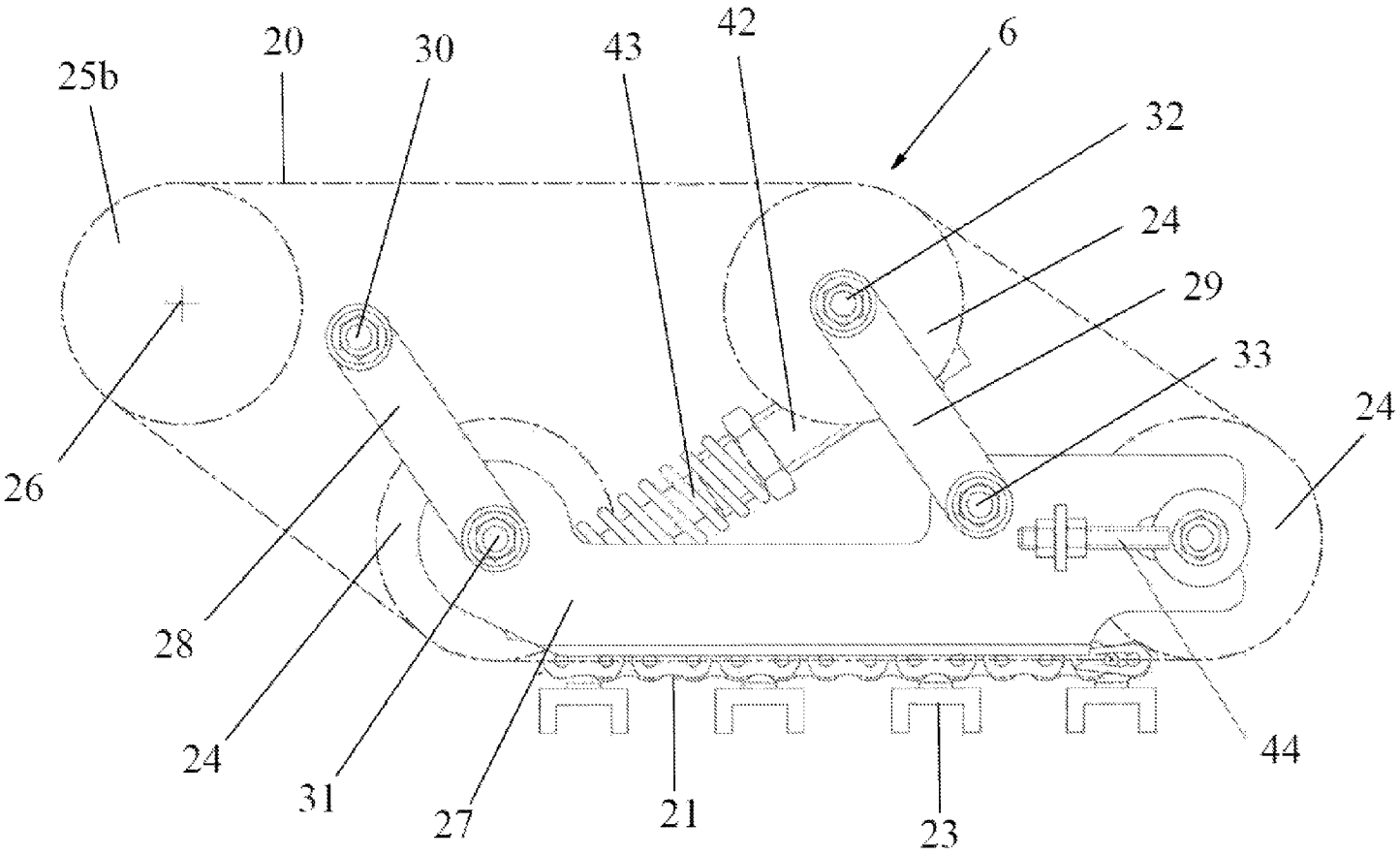
FIG. 3 is a partly sectional side view of the downwardly biased track system.

Referring to FIG. 3, the track assembly 6 generally comprises a continuous track 20 mounted on one or more idler rollers 24 and the drive roller 25*b*. Preferably, the track assembly 6 has three idler rollers 24. The track assembly 6 is mounted inside the track housing 3. In the preferred embodiment, the continuously looped track 20 generally comprises two strands of roller chain 21 in spaced apart relationship that are interconnected with track plates (not shown). The track plates are rigid or semi-rigid plates that are attached to the two strands of roller chain 21 and span the width of the track 20 to make up the primary structural surface of the continuous track 20.

The track plates are preferably provided with traction improving structures to grip the snow covered surface during use to assist in the propulsion of the motorized snowboard 1 by the continuous track 20. Preferably, the traction improving structures are drive paddles 23 bolted to the track plates, shown in FIG. 3.

In a preferred embodiment, the three idler rollers 24 and the drive roller 25*b* comprise barrel like rollers that span the width of the track assembly 6 and engage the two strands of roller chain 21 at each end of the roller. The longitudinal surface of each roller supports the track 20 along its width by the inwardly facing surface of the track plates, as the rollers rotate with the movement of the track 20. In another embodiment, the three idler rollers 24 and drive roller 25*b* comprise spaced apart pairs of sprockets, wheels or a combination of sprockets and wheels that engage with the two strands of roller chain 21 and are connected by an axle.

Preferably, the drive roller 25*b* and one of the three idler rollers 24 are mounted between the opposing sides of the track housing 3, with the idler roller 24 mounted rearward of the drive roller 25*b*, to form a top roller assembly.

The other two idler rollers 24 are rotably mounted in forward and aft spaced apart relationship to one another between opposing ends of a floating frame 27 to form a bottom roller assembly. The three idler rollers 24 engage with the roller chain 21 strands and freely rotate with the chain as the drive roller 25*b* imparts rotational motion to the chain.

The floating frame 27 is pivotally connected to the track housing 3 by a pair of link members 28 and 29 on each side of the housing. Link member 28 is pivotally connected to the track housing 3 with a pin connection 30 at one end and is pivotally connected to the floating frame 27 at the other end by a pin connection 31. Similarly, link member 29 is pivotally connected to the track housing 3 with a pin connection 32 at one end and is pivotally connected to the floating frame 27 at the other end by a pin connection 33. A preferred pivotal connection is a bolted pin connection.

The link members and corresponding pin connections allow for the floating frame 27 to pivot between a downwardly extended position and an upwardly retracted position. A suspension member may be provided to control the movement of the floating frame 27 between the downwardly extended position and the upwardly retracted position in order to downwardly bias the track assembly 6 against the ground and to dampen the vibrations of the snowboard during use caused by the terrain.

In the downwardly extended position, shown in FIG. 1, the floating frame 27 is correspondingly pivoted downwardly below the bottom surface 9 of the board 2. In the retracted position (not shown) the floating frame 27 is pivoted upwardly but the track assembly 6 remains in contact with the snow as will be described herein.

In the preferred embodiment, the suspension member is comprised of a shock absorber 42 having a compression coil spring 43. Alternative and or multiple suspension means may be provided; for example, a linear dashpot or damper. The length of the suspension member varies between an extended length and a compressed length with the application of force. Preferably, the suspension member is biased to the extended length, in the absence of an applied force, by the compression coil spring 43 and is compressed in response to the movement and operation of the board by the weight of the motorized snowboard 1 and operator.

In the preferred embodiment, the suspension member is pivotally mounted at opposing ends to the floating frame 27 and the track housing 3. The suspension member functions to limit or control the position of the floating frame 27 in relation to the track housing 3. With the suspension member fully extended the floating frame 27 is in the downwardly extended position. When the suspension member is compressed the floating frame 27 is in the upwardly retracted position. As discussed above, the suspension member is preferably biased to the extended length in the absence of applied force and resultantly the floating frame 27 is biased to the downwardly extended position. The bias force of the suspension member functions to maintain the operative contact at all material times between the track assembly 6 and the ground that a rider is travelling over.

The tension of the continuous track 20 may be adjustable by means of a tensioning device. In a preferred embodiment, the tensioning device is a screw assembly 44, shown in FIG. 3, which is used to selectively adjust the distance between the idler rollers 24 attached to the floating frame 27 and thereby adjust the tension of the continuous track 20. However, the tensioning device may be formed using any means known in the art.

In the preferred embodiment shown in FIG. 1, binding mounts 17 may be provided on either side of the motor 5 to facilitate the attachment of two conventional snowboard binding to the motorized snowboard 1 in spaced apart relationship to the top surface 8 of the board 2. The binding mounts 17 may be attached to the top surface 8 of the board 2 forward and aft of the motor 5 by any means known in the art. In the preferred embodiment the binding mounts 17 are attached to the motorized snowboard 1 by way of fasteners (not shown). The binding mounts 17 may be comprised of a planar top face that is large enough for the attachment of a conventional snowboard binding thereto and may be provided with threaded holes to facilitate the attachment of the conventional snowboard bindings thereto. When installed, the planar surface of the binding mount 17 may be parallel to, but spaced apart from the top surface 8 of the board 2 so that the bottom of the rider's boot, when in the binding, is raised up from the top surface 8 of the board 2.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A motorized snowboard comprising:

a board, having a top surface, a bottom surface, a width, a front portion, a rear portion, a midpoint, edges and an open channel in the rear portion between the opposing edges, the open channel having a forward portion at the midpoint of the board and a width less than that of the board;

a track housing attached to the midpoint of the board, having opposing sides, overlying the forward portion of the open channel;

binding mounts attached to the board forward and aft of the track housing;

a track assembly, comprising:

a continuous track, a top roller assembly having a leading roller and a trailing roller, each attached between the opposing sides of the track housing, a bottom roller assembly having a floating frame with opposing sides and a leading roller and a trailing roller each attached between opposing sides of the floating frame, wherein the floating frame is pivotally attached to the track housing, and a biasing mechanism to urge the floating frame downwardly; and a motor operatively connected to the track assembly for powering the continuous track.

2. The motorized snowboard of claim 1, wherein the pivotal attachment of the floating frame to the track housing is by means of two or more link members with first and second ends, each being pivotally connected to the track housing at their first end and pivotally connected to the floating frame at their second end.

3. The motorized snowboard of claim 2, wherein the leading roller and trailing roller of the bottom roller assembly are rearwardly offset from the leading roller and trailing roller of the top roller assembly.

4. The motorized snowboard of claim 3, wherein the continuous track comprises a roller chain and track plates.

5. The motorized snowboard of claim 4, further comprising drive paddles attached to the track plates.

6. The motorized snowboard of claim 5, wherein the motor has a drive shaft and the operative connection between the motor and the track assembly comprises a drive chain operatively engaged with one or more of the rollers of the track assembly to impart rotational motion thereto for propelling the motorized snowboard.

7. The motorized snowboard of claim 6, wherein the drive chain is operatively engaged with the leading roller of the top roller assembly to impart rotational motion thereto for propelling the motorized snowboard.

8. The motorized snowboard of claim 7, wherein the leading roller of the top roller assembly comprises a roller or a sprocket.

9. The motorized snowboard of claim 8, wherein the floating frame pivots between a first and second position and all intermediary points therebetween.

10. The motorized snowboard of claim 9, wherein the lowest portion of the track assembly protrudes just below the bottom surface of the board while the floating frame is in the first position and the lowest portion of the track assembly is at the farthest point from the bottom surface of the board permitted by the link members while the floating frame is in the second position.

11. The motorized snowboard of claim 10, wherein the biasing mechanism comprises a suspension member.

12. The motorized snowboard of claim 11, wherein the suspension member controls the movement of the floating frame between the first position and the second position.

13. The motorized snowboard of claim 12, wherein the suspension member varies in length between an extended length and a compressed length and is biased to the extended length.

14. The motorized snowboard of claim 13, wherein the bias to the extended length functions to maintain operative contact between the track assembly and an underlying ground surface when the board is in use.

15. The motorized snowboard of claim 14, wherein the one or more suspension members are comprised of shock absorbers and compression coil springs pivotally mounted to the floating frame at one end and the track housing at the other end.

16. The motorized snowboard of claim 15, wherein the open channel extends rearwardly from about the midpoint of the board.

17. The motorized snowboard of claim 16, further comprising a tensioning device on the frame to selectively adjust the distance between the rollers to thereby adjust the tension on the continuous track.

18. A motorized snowboard comprising:

a board, having a top surface, a bottom surface, a width, a front portion, a rear portion, a midpoint, edges and an open channel in the rear portion between the opposing edges, the open channel having a forward portion at the midpoint of the board and a width less than that of the board;

a track housing attached to the midpoint of the board, having opposing sides, overlying the forward portion of the open channel;

binding mounts attached to the board on either side of the track housing;

a track assembly, comprising:

a continuous track, a floating frame having opposing sides, pivotally attached to the track housing, two or more rollers, one of which is a leading roller and one of which is a trailing roller, in forward and aft spaced apart relationship, wherein said trailing roller is attached between opposing sides of the floating frame, and a biasing mechanism to urge the floating frame downwardly with reference to the board; and a motor operatively connected to the track assembly for powering the continuous track.

* * * * *